US005668886A

United States Patent [19]

Sakamoto et al.

[11] Patent Number: 5,668,886

[45] Date of Patent: Sep. 16, 1997

[54] LOUDSPEAKER STRUCTURE

[75] Inventors: Yoshio Sakamoto; Shuhei Ohta, both of Hachioji, Japan

[73] Assignee: Kabushiki Kaisha Kenwood, Tokyo, Japan

[21] Appl. No.: 662,291

[22] Filed: Jun. 13, 1996

Related U.S. Application Data

[63] Continuation of Ser. No. 219,528, Mar. 29, 1994, abandoned.

[30] Foreign Application Priority Data

Mar. 30, 1993 [JP] Japan ..... 5-071625

[51] Int. Cl.[6] ..... H04R 25/00

[52] U.S. Cl. ..... 381/199; 381/202; 381/203; 381/193

[58] Field of Search ..... 381/199, 202, 381/203, 193, 204

[56] References Cited

U.S. PATENT DOCUMENTS

| | | | |
|---|---|---|---|
| 3,746,898 | 7/1973 | Austin et al. . | |
| 3,937,905 | 2/1976 | Manger . | |
| 4,198,550 | 4/1980 | Matsuda et al. | 381/203 |
| 4,868,882 | 9/1989 | Ziegenberg et al. | 381/200 |
| 5,123,053 | 6/1992 | House | 381/188 |
| 5,371,806 | 12/1994 | Kohara et al. | 381/199 |

FOREIGN PATENT DOCUMENTS

| | | | |
|---|---|---|---|
| 3935786 | 5/1991 | Germany | 381/202 |
| 0107333 | 8/1979 | Japan | 381/202 |
| 62-053598 | 3/1987 | Japan . | |
| 2257600 | 1/1993 | United Kingdom . | |

*Primary Examiner*—Sinh Tran

*Attorney, Agent, or Firm*—Sixbey, Friedman, Leedom & Ferguson; Gerald J. Ferguson, Jr.; Bradley D. Blanche

[57] ABSTRACT

A high performance loudspeaker structure is provided which is of reduced thickness yet resistible to large vibration amplitudes. A repulsion magnetic circuit is formed by two magnets with the same poles being faced each other and a center plate interposed between the two magnets. The repulsion magnetic circuit is held in position by two frames. A diaphragm is mounted at the level flush with the center of the winding width of a voice coil. The outer periphery of an edge (suspension) bonded to the outer circumference of the diaphragm is held by flanges of the frames.

5 Claims, 4 Drawing Sheets

LOUDSPEAKER STRUCTURE

This application is a Continuation of Ser. No. 08/219,528, filed Mar. 29, 1994, now abandoned.

BACKGROUND OF THE INVENTION

1. Field of the Invention

The present invention relates to a structure of a loudspeaker having a repulsion magnetic circuit, the loudspeaker being thin and suitable for reproducing low frequency sounds and reproducing sounds at large vibration amplitudes.

2. Related Background Art

The structure of a conventional loudspeaker having a repulsion magnetic circuit is shown in FIGS. 6 and 7.

There is a strong desire to make a vehicle door-mounted loudspeaker thin and light in weight, because doors of a vehicle have become thin in order to increase the inner space of the vehicle and because the space for mounting the loudspeaker has become small in order to mount other devices, such as an automatic door locking mechanism and an automatic window opening/closing mechanism in the door.

A small space in the door means a small space behind the diaphragm of a loudspeaker, resulting in a poor acoustic performance. As a result, sounds radiated from the loudspeaker, particularly low frequency sounds, are adversely affected.

In order to intensify low frequency sounds, it is therefore necessary to make a loudspeaker as thin as possible and the effective space in a door as large as possible.

Japanese Patent Laid-open publication No.1-98400 and the like teach that a repulsion magnetic circuit structure is effective in reducing the thickness of a loudspeaker, the structure having two magnets magnetized in the thickness direction and disposed with the same poles being faced each other.

As shown in FIGS. 6 and 7, according to this repulsion magnetic circuit structure, a flat diaphragm 150 is adhered to the upper end of a bobbin 141, and another diaphragm 152 is adhered to the lower end of the bobbin 141. The latter diaphragm 152 has an outer circumference area slanted and raised to the bottom surface of the flat diaphragm 150 where the diaphragms 150 and 152 are joined together.

The repulsion magnetic field type loudspeaker shown in FIG. 6 is structured such that a corrugation or edge extends radially from the outer circumference of the diaphragm 150. The diaphragm 150 and corrugation or edge are disposed above the bobbin 141 and a bobbin coil 140. A suspension, coil lead wires, input terminals 171, and the like are disposed under the bobbin 141.

The repulsion magnetic field type loudspeaker shown in FIG. 7 has a tipple structure of magnets 131, 132, and 135 constituting a magnetic circuit and a two-stage structure of upper and lower voice coils 140 and 143 to which diaphragms 150 and 151 are adhered. This loudspeaker is therefore thick.

In the case of the loudspeaker shown in FIG. 6, it is necessary to keep a space necessary for accommodating the diaphragm 150 and corrugation above the voice coil 140 and bobbin 141 in the sound radiation direction, as well as an additional space for permitting the vibration of the diaphragm 150. Furthermore, it is necessary to keep a space under the voice coil 140 and bobbin 141 on the back side of the loudspeaker, this space being necessary for accommodating the diaphragm 152 and the coil lead wires and input terminals under the diaphragm 152. The coil lead wires are required not to contact the diaphragm 152, a frame 120, and the like. From these reasons, the loudspeaker shown in FIG. 6 becomes thick.

The above-described structure also limits a vibration amplitude of the diaphragm 150, and an available space left in the door is small as described above. Therefore, low frequency sounds in particular are difficult to be reproduced from a loudspeaker, and a power performance (maximum allowable input power characteristics) is very low, as compared to another loudspeaker having the same diameter and used in a larger space.

In the case of the loudspeaker shown in FIG. 7, the tipple structure of the magnets 131, 132, and 135 and the two-stage structure of the voice coils 140 and 143 increase the thickness of the loudspeaker and reduce the space behind the loudspeaker. Furthermore, the outer circumferences of the diaphragms 150 and 151 are directly fixed to an outer frame 122 so that low frequency sounds are difficult to be reproduced more than the loudspeaker shown in FIG. 6 and the power performance is extremely low. This loudspeaker is low in practical value as a door-mounted loudspeaker.

SUMMARY OF THE INVENTION

It is an object of the present invention to solve the above-described conventional problems and provide a loudspeaker structure suitable for making a loudspeaker thin and resistible to large vibration amplitudes.

According to one aspect of the present invention, there is provided a structure of a loudspeaker having two magnets magnetized in the thickness direction and disposed with the same poles being faced each other, a magnetic member interposed between the two magnets, and a diaphragm with a voice coil disposed in a magnetic field generated in the vicinity of the outer circumference of the magnetic member, wherein the diaphragm and a suspension bonded to the outer circumference of the diaphragm are disposed at a level in the range from the top to the bottom of the voice coil.

In the loudspeaker structure, a neck portion bonding the diaphragm and the voice coil, the outer circumference of the diaphragm, and the outer circumference of the suspension are positioned on a plane passing through the center of the winding width of the voice coil.

In the loudspeaker structure, the cross section of the diaphragm has a width gradually narrowing near from a neck portion to the suspension.

In the loudspeaker structure, at least one of the front and back surfaces of the diaphragm is corrugated concentrically with the voice coil, or is provided with a rib of a drawing structure extending radially.

In the loudspeaker structure, the diaphragm is made of at least two diaphragms assembled together, and a core member made of a foaming member or a core member having a honeycomb structure is inserted between at least the two diaphragms.

According to another aspect of the present invention, there is provided a structure of a loudspeaker having two magnets magnetized in the thickness direction and disposed with the same poles being faced each other, a magnetic member interposed between the two magnets, and a diaphragm with a voice coil disposed in a magnetic field generated in the vicinity the outer circumference of the magnetic member, the diaphragm and a suspension bonded to the outer circumference of the diaphragm being disposed at a level in the winding width range of the voice coil, wherein the magnets are held by holding sections formed on two outer frames of the loudspeaker, each of the outer frames having a sound radiating area, and the outer circumference areas of the frames holding the outer circumference areas of the suspension.

In the loudspeaker structure, the two frames have the same shape.

In the loudspeaker structure, the holding sections of the frames are projections formed on the central area thereof and extending inwardly.

In the loudspeaker structure, at least one of the sound radiating areas of the frames has punching holes.

In the loudspeaker structure, input terminals of the voice coil are mounted near the outer circumference of the suspension, the height of the terminals being lower than the thickness of the frames.

According to the repulsion magnetic type loudspeaker of the present invention, the diaphragm and the suspension bonded to the outer circumference of the diaphragm are disposed at a level in the range from the top to the bottom of the voice coil, the magnets and the outer circumference of the suspension are held by the outer frames of the loudspeaker, the frames having the sound radiating areas. Accordingly, a space in which the diaphragm and the suspension vibrate, is limited to a space in which the voice coil vibrates, allowing the loudspeaker to be made thin.

The neck portion bonding the diaphragm and the voice coil, the outer circumference of the diaphragm, and the outer circumference of the suspension are positioned in the vicinity of the center of the winding width of the voice coil. Accordingly, the front and back areas of the loudspeaker unit become symmetrical and the frames of the same shape can be used.

The cross section of the diaphragm has a width gradually narrowing from a neck portion to the suspension. Accordingly, the cross section of the frames can be made thin toward the outer circumference thereof.

At least one of the front and back surfaces of the diaphragm is corrugated concentrically with the voice coil, or is provided with a rib of a drawing structure extending radially from the inner circumference of the diaphragm. Accordingly, the rigidity of the diaphragm becomes high.

The diaphragm is made of at least two diaphragms assembled together, and a core member made of a foaming member or a core member having a honeycomb structure is inserted between at least the two diaphragms. Accordingly, the rigidity of the diaphragm can be made higher.

The two frames have the same shape so that the same metal mold can be used for manufacturing them.

The holding sections of the frames are projections formed on the central area thereof and extending inwardly. Therefore, the magnetic circuit made of the magnets and the center plate can be reliably held in position by the projections, without using an additional support member for the magnets, thereby making the loudspeaker thin and light in weight.

At least one of the sound radiating areas of the frames has punching holes, thereby realizing the loudspeaker having good high frequency characteristics.

The input terminals of the voice coil are mounted near the outer circumference of the suspension, and the height of the terminals is made so as not to exceed the maximum thickness of the frames. Accordingly, a mount space of the loudspeaker is less than the space corresponding to the maximum thickness of the frames.

DETAILED DESCRIPTION OF THE PREFERRED EMBODIMENT

An embodiment of the loudspeaker structure according to the present invention will be described with reference to FIGS. 1 to 5.

Figure 1:
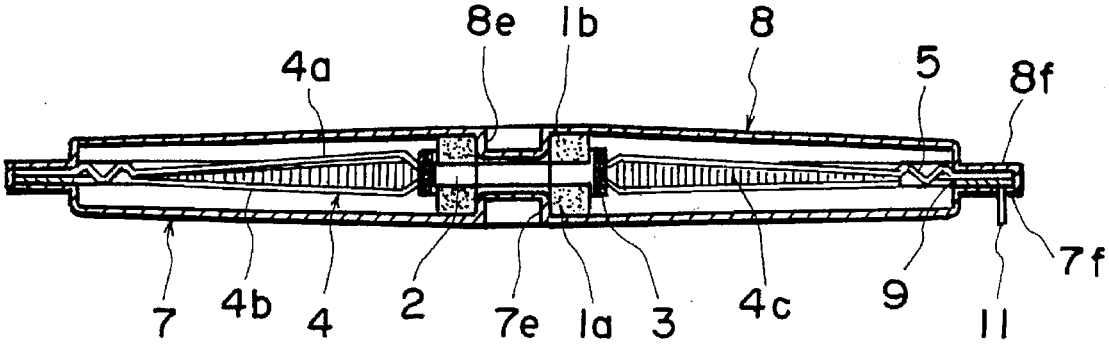
FIG. 1 is a cross sectional view showing the structure of a loudspeaker according to an embodiment of the present invention.

In FIG. 1, reference numerals with affixes 1*a* and 1*b* represent magnets made of neodymium having the same ring shape. The two magnets 1*a* and 1*b* are magnetized in the thickness direction and disposed with the same poles being faced each other. A center plate 2 made of soft magnetic material such as iron is tightly held between the magnets 1*a* and 1*b*. A repulsion magnetic circuit is thus formed.

The structure of the repulsion magnetic circuit will be detailed. The magnets 1*a* and 1*b* each has a size of an outer diameter of 29 mm, an inner diameter of 12 mm, and a thickness of 7 mm, and the center plate 2 has a size of an outer diameter of 30 mm, an inner diameter of 11 mm, and a thickness of 4 mm. The magnets 1*a* and 1*b* with the N poles facing each other and the center plate 2 held therebetween are fixed by adhesive agent. The magnetic circuit is fixed to a frame 7 by coating adhesive agent on the surface of a projection 7*e* (an outer diameter of 11.78 mm and a height of 2 mm) formed at the central area of the frame 7 and by fitting the hole of the magnet 1*a* around the projection 7*e*.

A bobbin-less voice coil 3 uses a slit wire of aluminum having an edgewise (rectangle section) structure. The voice coil 3 has a coil winding unit 3*b* which has no bobbin and has an inner diameter of 30.5 mm, a winding width of about 5 mm, and a d.c. resistance of 3.4 Ω. An insulating tape 3*d* is attached to the outer side wall of the voice coil 3, and two copper foils 3*c* are attached to the surface of the insulating tape 3*d* disposed side by side and spaced apart from each other. The winding start and end of the coil are soldered to the copper foils 3*c*.

A diaphragm 4 is constituted by front and back diaphragms 4*a* and 4*b*. A core member 4*c* is interposed between the diaphragms 4*a* and 4*b*. The core material 4*c* is made of balsa worked in a predetermined shape. The balsa has voids and light in weight. Pulp sheets compression-molded into a shape matching the outer shape of the core member 4*c* are attached on the front and back surfaces of the core member 4*c*. In this manner, the diaphragm 4 is formed which has a high rigidity and can suppress local resonances. As shown in FIG. 1, the cross section of the diaphragm 4 has a shape symmetrical to a lateral center line thereof, having a thickness of about 4 mm at the inner circumference area and gradually reducing its thickness toward the outer circumference. The overall shape of the diaphragm 4 is a disk having an outer diameter of about 110 mm.

The diaphragm 4 is thinner than the width of the voice coil 3, and the inner circumference area (neck area) of the diaphragm 4 is adhered to the central area of the outer wall of the voice coil 3.

An edge 5 providing a suspension function is joined at its inner circumference area to the outer circumference area of the diaphragm 4, the outer circumference area of the edge being fixed to a flange 7*f* of the frame 7 via an insulating ring 9 made of Bakelite and having a thickness of 1.5 mm.

Figure 2A:
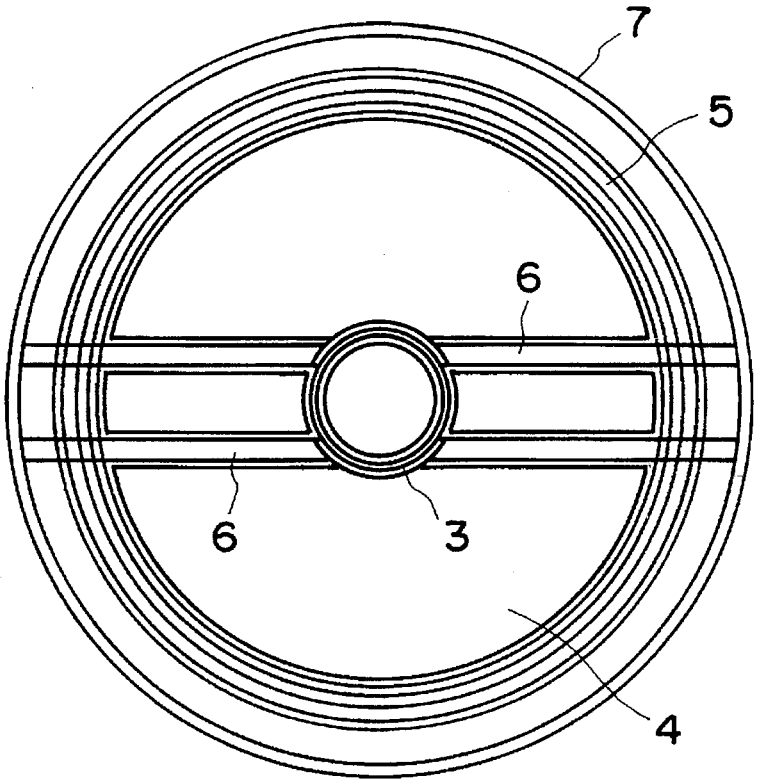
FIGS. 2A and 2B are a plan view showing the diaphragm unit with removed frames, and a side view showing the main part of the diaphragm unit.
Figure 3:
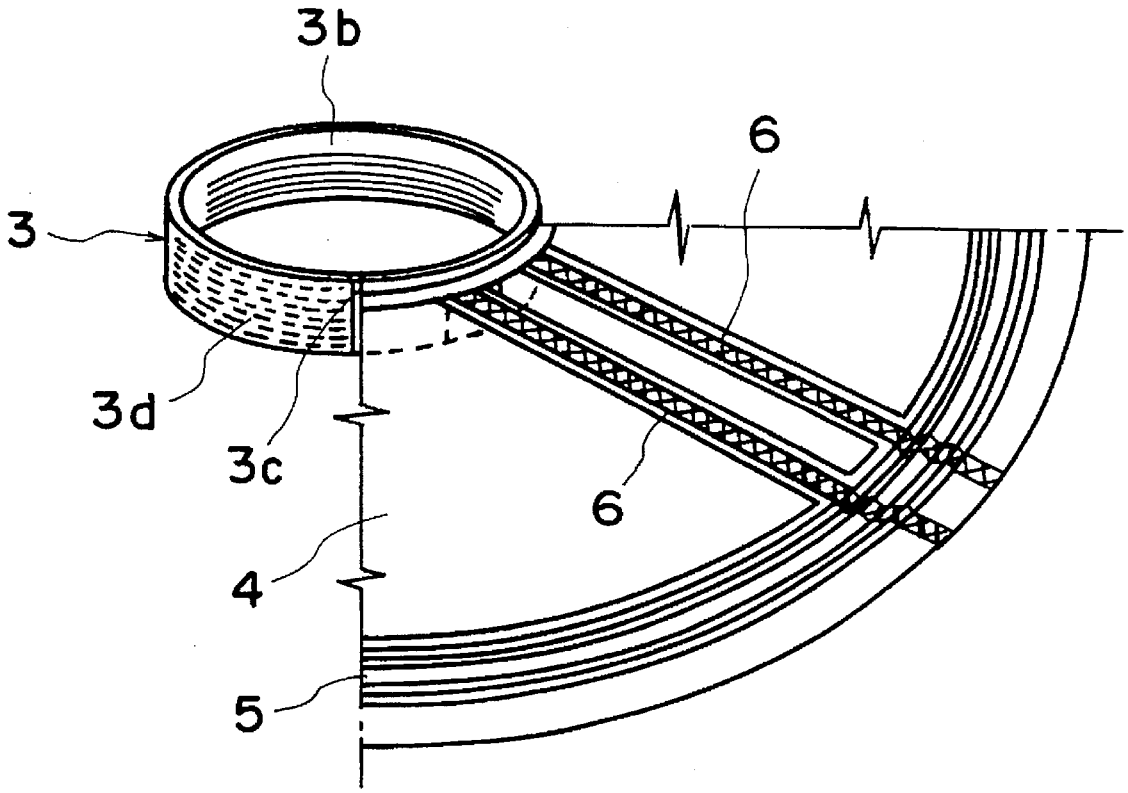
FIG. 3 is a perspective view showing part of the voice coil and diaphragm of the embodiment.

Lead wires 6 connect the copper foils 3*c* attached on the outer wall of the voice coil 3 to input terminals 11. The lead wire 6 is made of a woven cloth (edge member) or the like of an insulating material and a conductive, flexible, and flat woven tinsel wire sewed on the woven cloth. The lead wires 6 are molded by hot pressing into a shape matching the shape of the diaphragm 4 and edge 5, and attached to the surface of the diaphragm 4 and edge 5 extending in generally parallel from the copper foils 3*c* to the input terminals 11. As shown in FIG. 3, the woven cloth is trimmed so as to have a width slightly wider than that of the flat woven tinsel wire. Another pair of lead wires 6 are attached also on the side having no input terminal as shown in FIG. 2A, to thereby provide a dynamic balance of the loudspeaker.

Figure 2B:
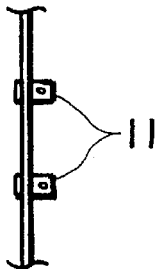

The two lead wires 6 are soldered to the copper foils 3*c* corresponding the winding start and end of the coil winding unit 3*b* at the inner circumference area of the diaphragm 4, and also to the input terminals 11 of two lug plates shown in FIG. 2B. In this manner, an electrical connection between the winding start and end and the input terminals 11 can be established.

In assembling the diaphragm 4 and the voice coil 3, the voice coil 3 is first loaded in a assembly jig (not shown), and then the inner circumference of the diaphragm 4 is fitted around the outer wall of the voice coil 3. In this state, the copper foils 3*c* attached to the outer wall of the voice coil 3 and soldered to the winding start and end thereof are soldered to the flat woven tinsel lead wires 6 extended to the inner circumference of the diaphragm 4. In addition, the C-plane areas formed at the inner circumference area of the diaphragm 4 on both the front and back surfaces are coated with adhesive agent to bond the voice coil 3 and diaphragm 4.

This vibration system is then mounted to the frame 7 to which the magnetic circuit has been adhered. Another frame 8 having the same shape as the frame 7 is mounted to thus complete the loudspeaker.

The edge 5 fixed to the ring 9 of Bakelite at the flange 7*f* of the frame 7 is substantially flush with the center of the width of the voice coil 3.

In the loudspeaker assembled as above, the center of gravity of the vibrating system is located on the plane passing through the center of the winding width of the voice coil. The position of this center of gravity functions as the driving point of the loudspeaker. Therefore, only the outer periphery suspension such as the edge 5 can support the vibrating system, without using a conventional inner periphery suspension such as a damper, and a rolling at a large vibration amplitude is small.

Figure 4A:
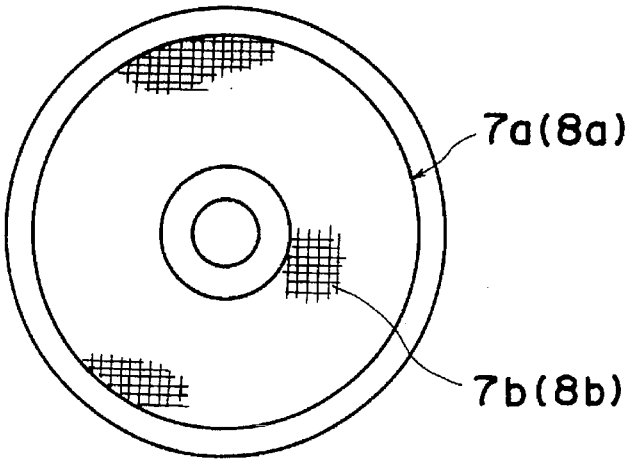
FIGS. 4A to 4C are front views showing the shapes of holes formed in a sound radiating area, the shapes including tiny punching holes shown in FIG. 4A, circle holes shown in FIG. 4B, and fan-shaped holes shown in FIG. 4C.
Figure 4B:
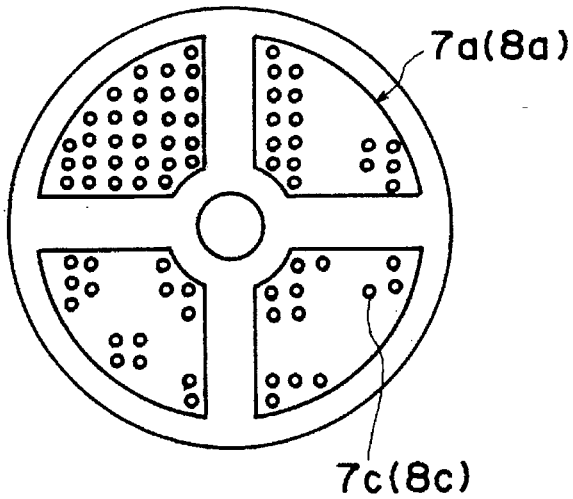
Figure 4C:
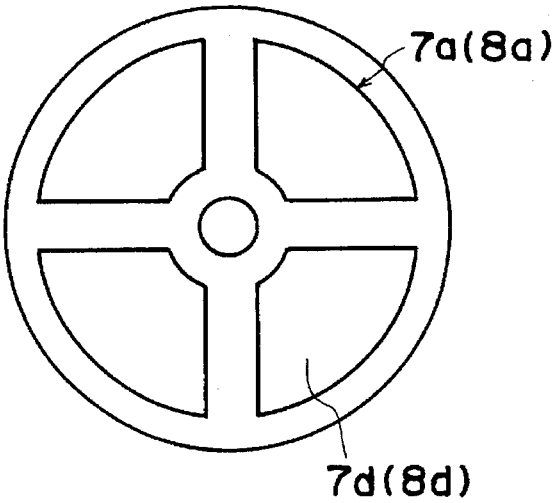

The frames 7 and 8 have the same shape so that they can be manufactured economically by using the same metal mold. The acoustic filter characteristics of the loudspeaker can be changed by forming holes having different shapes in sound radiating areas 7*a* and 8*a* of the frames 7 and 8. Specifically, as shown in FIGS. 4A to 4C, punching holes 7*b* and 8*b* of a rectangle shape or a circle shape as illustratively shown in FIG. 4A, circle holes 7*c* and 8*c* as shown in FIG. 4B, or fan-shaped holes as shown in FIG. 4C are used, or the shapes of holes may be changed between the two frames 7 and 8. The high frequency band characteristics of the loudspeaker can be controlled as desired by using punching holes 7*b* and 8*b*.

A sample of a 16 cm loudspeaker having the structure of this invention showed a resonance frequency of 60 Hz enabling to move the lower frequency limit to a sufficiently low value, provided a stroke (amplitude) of the diaphragm of about 12.5 mm, had a total thickness of 20 mm or less including a frame thickness, and ensured a rated maximum allowable input power of 50 to 70 W without using an inner periphery suspension (damper).

Figure 5:
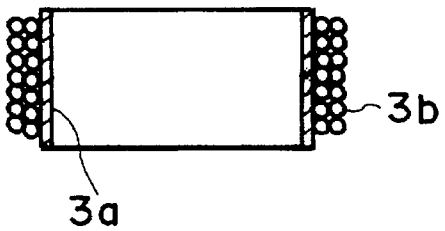
FIG. 5 is a cross sectional view showing a general voice coil.
Figure 6:
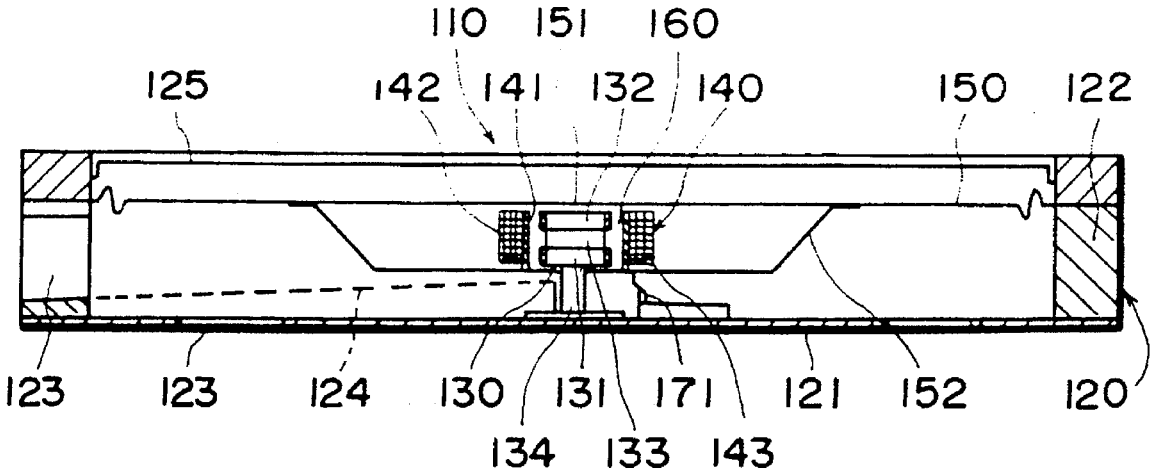
PRIOR ART FIG. 6
FIG. 6 is a cross sectional view showing a conventional loudspeaker structure.
Figure 7:
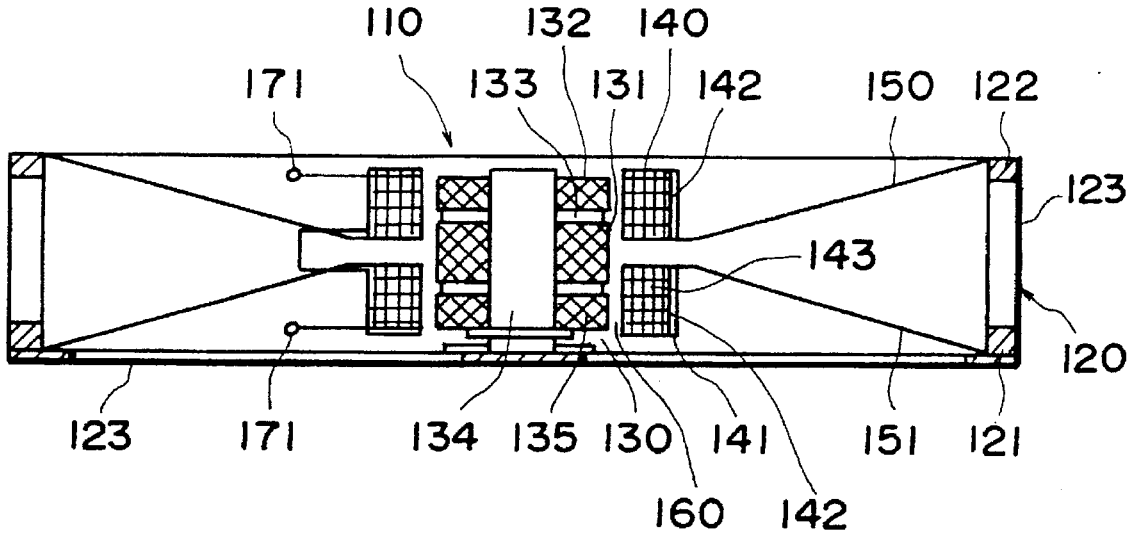
PRIOR ART FIG. 7
FIG. 7 is a cross sectional view of another conventional loudspeaker structure.

In this embodiment, although the voice coil 3 having no bobbin has been described, the invention is not limited only to it, but a bobbin 3*a* such as shown in FIG. 5 may be used.

In this embodiment, the cross section of the diaphragm 4 is of a wedge shape gradually reducing the thickness from the inner circumference area to the edge 5, and the inner circumference area and edge 5 are fixed to the center of the winding width of the voice coil 3. Instead, the inner circumference area and edge 5 may be fixed to any position in the range of the winding width of the voice coil 3.

In this embodiment, the diaphragm 4 has a sandwich structure disposing the core member 4*c* inside of the diaphragm 4. The structure of the diaphragm 4 may be changed in accordance with an application object, or the structure of the core member 4 may be changed. For example, the core member 4*c* may have a honeycomb structure, the core member 4*c* may be omitted, the front and back diaphragms 4*a* and 4*b* may have different shapes, or the diaphragm 4 may be formed by a single diaphragm.

In this embodiment, although the flat woven tinsel lead wires 6 are extended in parallel, each lead wire 6 may be extended symmetrically relative to the central axis of the voice coil 3 by mounting two lug terminals at the corresponding positions. A plurality of lead wires 6 may be used if necessary.

According to the present invention, the projections 7*e* and 8*e* for holding the magnets 1*a* and 1*b* are extended to the inside of the frames 7 and 8. Instead, the projections may be extended to the outside of the frames to hold the magnets at their outer walls.

The following advantageous effects can be obtained by the loudspeaker structure of this invention.

(1) The repulsion magnetic circuit is held by the frames 7 and 8 at the central areas thereof, the edge 5 at the outer periphery of the diaphragm is fixed to the flange 7*f*, and the lead wires 6 of the voice coil 3 are attached to the diaphragm 4 and edge 5. Accordingly, the diaphragm 4 and edge 5 can be positioned in the range of the winding width of the voice coil 3, and the assembly of the lead wires 6 can be achieved in this configuration. The components such as the magnetic circuit and input terminals 11 can be accommodated in a space within the vibration amplitude range of the voice coil 3. The structure of a loudspeaker which is theoretically thinnest can be provided.

(2) The thin loudspeaker of this structure is resistible to large vibration amplitudes and has a very high maximum allowable input power performance.

(3) Since the edge 5 is positioned at the center of the winding width of the coil winding unit 3*b*, a rolling of the vibration system is not likely to occur. Accordingly, the loudspeaker structure excellent in reproducing low frequency sounds can be provided even for a thin loudspeaker.

(4) A desired sound quality can be obtained by changing holes formed in the sound radiating areas of the frames 7 and 8 having the same shape. The high frequency characteristics of the loudspeaker can be set as desired by forming punching holes 7*b* and 8*b* in the sound radiating areas.

(5) The repulsion magnetic circuit of the loudspeaker structure has fewer components, and lead wires are soldered for the electrical connection. Accordingly, assembly of the loudspeaker is simple and the costs of both components and assembly works can be reduced.

(6) In this loudspeaker structure, lead wires are attached to the diaphragm so as to reliably prevent the breakage of the lead wires and the generation of abnormal sounds.

(7) The frames 7 and 8 are formed with the projections 7*e* and 8*e* for holding and position-aligning the magnetic circuit. Accordingly, the loudspeaker can he assembled easily. Since the magnetic circuit is squeezed by the frames 7, a sufficient mechanical strength can be easily obtained even if thin frames are used.

(8) The lead wire 6 to the voice coil 3 is made of the insulating woven cloth (edge material) and the flat woven tinsel wire sewed on the woven cloth which is attached to the surface of the diaphragm 4. Accordingly, even if the material of the diaphragm is conductive, such as carbon fiber, aluminum alloy foil, and the like, there is no fear of a short-circuit.

What is claimed is:

1. A structure of a loudspeaker having two magnets magnetized in the thickness direction and disposed with the same poles being faced each other, a magnetic member interposed between the two magnets, and a diaphragm with a voice coil disposed in a magnetic field generated in the vicinity of the outer circumference of the magnetic member, said diaphragm and a suspension bonded to the outer circumference of said diaphragm being disposed at a level in the winding width range of said voice coil, wherein said magnets are held by holding sections formed on two outer frames of the loudspeaker, said outer frames having sound radiating areas, and the outer circumference areas of said frames holding the outer circumference areas of said suspension wherein said holding sections of said outer frames are projections formed on a central area of said outer frames and extending inwardly.

2. A structure of a loudspeaker having two magnets magnetized in the thickness direction and disposed with the same poles being faced each other, a magnetic member interposed between the two magnets, a diaphragm, and a voice coil disposed in a magnetic field generated in the vicinity of the outer circumference of the magnetic member, wherein said diaphragm is configured as a taper structure, an outer narrow edge of said taper structure diaphragm being connected through a suspension to a frame and an inner edge of said taper structure diaphragm being connected to said voice coil, and said taper structure diaphragm has a rigidity to support said voice coil without providing additional suspension means of supporting said voice coil, the frame comprising a front plate and a rear plate which are substantially parallel to each other and the two magnets being fixed to the centers of the opposing front and rear frame plates, and wherein the center lines of said suspension, diaphragm, voice coil and magnetic member are arranged horizontally in a line, and said front plate and said rear plate each include a projection at the center thereof, said two magnets are rings, and the center holes of said magnets are engaged with the projections.

3. A structure according to claim 1, wherein said diaphragm is configured as a taper structure.

4. A structure according to claim 1, wherein the center lines of said suspension, diaphragm, voice coil and magnetic member are arranged horizontally in a line.

5. A structure according to claim 1, further comprising a lead (6) of flat woven tinsel wire attached onto the surface of said diaphragm.

* * * * *